US006439432B1

(12) United States Patent
Park

(10) Patent No.: US 6,439,432 B1
(45) Date of Patent: Aug. 27, 2002

(54) PERSONAL SAFETY DEVICE

(76) Inventor: John S. Park, 7419 Quinn St., Downey, CA (US) 90241

( * ) Notice: Subject to any disclaimer, the term of this patent is extended or adjusted under 35 U.S.C. 154(b) by 32 days.

(21) Appl. No.: 09/782,327

(22) Filed: Feb. 13, 2001

(51) Int. Cl.[7] ..... B65D 5/66
(52) U.S. Cl. ..... 222/113; 222/153.11; 340/425.5
(58) Field of Search ..... 222/1, 79, 113, 222/192, 153.11, 153.13, 325, 402.11; 340/425.5

(56) References Cited

U.S. PATENT DOCUMENTS 4,982,645 A * 1/1991 Abboud ..... 222/325
5,310,086 A * 5/1994 Julinot ..... 222/1
5,517,180 A * 5/1996 Masi et al. ..... 340/425.5
5,531,359 A * 7/1996 Winner ..... 222/153.11
6,052,051 A * 4/2000 Whalen ..... 340/425.5
6,237,461 B1 * 5/2001 Poole ..... 222/1

* cited by examiner

*Primary Examiner*—Philippe Derakshani
*Assistant Examiner*—Thach H Bui
(74) *Attorney, Agent, or Firm*—Hung B. Tran; Maria Erlinda C. Sarno

(57) ABSTRACT

An apparatus disguised as a flashlight to be used as a self protection device. This apparatus includes a housing ergonomically designed to fit a user's hand. Included in the housing are a battery, a low battery indicator device, a lighting device, a chemical spray canister, a shocking primary electrode and an additional shocking electrode, each component having a trigger assembly. The primary electrodes are triggered by a trigger switch. The additional electrode is triggered by applying force on the electrodes. The apparatus is used to either shoot the chemical spray at an assailant at a distance, or use the shocking primary electrode at a close distance, if the assailant is in front of a victim. When the assailant is at the back of the victim, the bottom additional electrode is activated for use while at the same time deactivating the shocking primary electrode. The personal safety device has a safety device that can disable the personal safety device when it is pulled from a user.

26 Claims, 11 Drawing Sheets

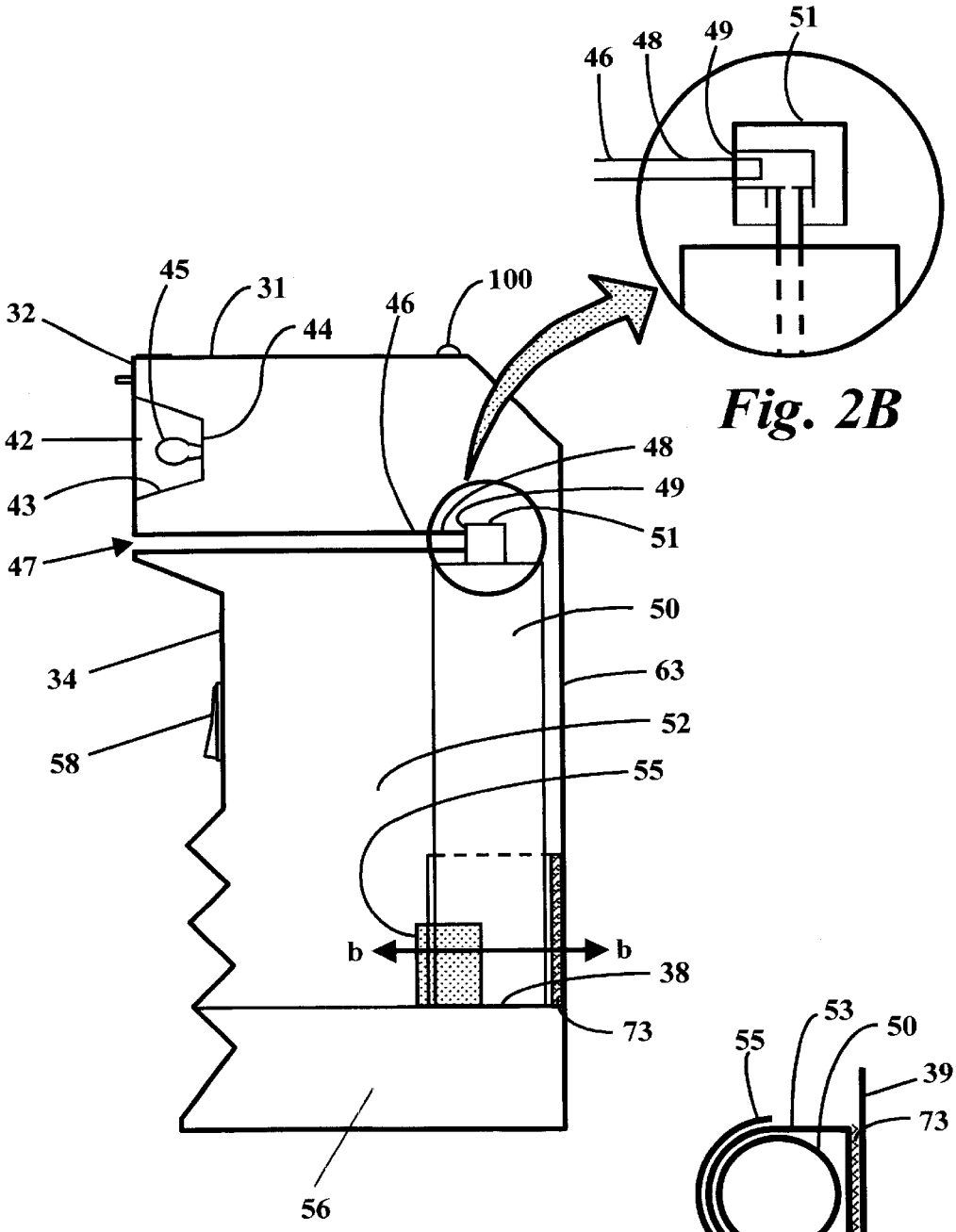
Fig. 2B
Fig. 2
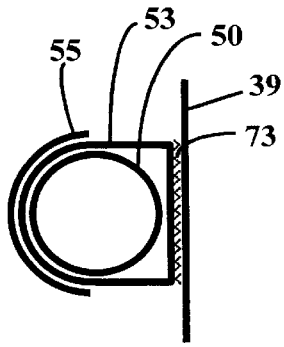
Fig. 2A

PERSONAL SAFETY DEVICE

BACKGROUND

The present invention relates to a personal safety device for self protection using a combination of self protection components and safety switches capable of defending attackers from the front or the back of the victim. The personal safety device is inactivated when the safety door disengages from the device such as when an assailant grabs the personal safety device from the user.

Historically the primary responsibility for personal protection has always fallen on the individuals. This is true regardless of the community where one lives. Police agencies have been unable to protect everyone. Living in and around our large metropolitan cities requires that individuals, whether alone or with others, take precautionary measures to protect themselves against personal assaults. Various personal safety devices are available, including firearms, stun guns, chemical sprays, audible alarms and wireless security services.

Firearms, when accessible and handled properly, are good deterrents against an aggressor. However, carrying a firearm might not be an option especially to individuals who oppose the possession and use of firearms, or who are generally intimidated by firearms. Furthermore, the idea that death may occur because of the use of firearms also makes this form of self protection undesirable. In addition, many jurisdictions require the registration of the firearm and/or a permit for concealed weapons. These registrations either hinder or prevent an individual from these forms of personal defense.

Other personal protection devices such as chemical sprays, for example, pepper sprays, audible personal security alarms, and stun guns, when used properly, all have a deterrent effect on an aggressor without the consequences associated with a firearm. These devices, however, have limitations and can prove to be ineffective depending upon the circumstances.

For example, a stun gun can be effective in warding off aggressors as that shown in U.S. Pat. No. 6,002,120. The aggressor, however, must be reasonably close, usually within an arms length, to effect an electric shock on the assailant. Further, due to its design and function, a stun gun can be ineffective when the assailant attacks a person from behind.

Chemical sprays and audible alarms have their advantages and disadvantages. Chemical sprays as shown in U.S. Pat. No. 5,865,348 generally offer a user the advantage of deterring an assailant at a distance of as much as 10 to 15 feet, as well as giving notice to the assailant that the user is not totally defenseless. However, a chemical spray is useless when the assailant covers his eyes with eyeglasses. Audible alarms on the other hand when used as a stand alone device has lost its usefulness, since most people in the metropolitan city areas no longer pay attention to such sound generated devices.

Further, in all of these known self defense devices, there are no mechanisms built in to deactivate the device which is necessary especially when an assailant takes possession of the device by force and uses the device on the user.

It is therefore an object of this invention to provide a simple device for self-defense combining the benefits of light, chemical spray, low battery indicator and stun gun in a simple device, thereby enabling a prospective victim to defend himself/herself, wherever the assailant is situated, from either the front or the back.

It is a further object of this invention to incorporate a deactivating mechanism for safety and for preventing an assailant to use the user's own personal safety device against the user.

SUMMARY OF THE INVENTION

The present invention is a personal safety device comprising of a combination of a lighting device, a chemical spray in a canister and shocking electrodes and means for triggering each of these in a housing designed to ergonomically accommodate a hand, having a means for securing the safety device to a user's hand. A unique feature of the personal safety device is its ability to be disabled once it is pulled by an assailant from a user's hand so long as the user is using the safety device correctly. This is important so that the same safety device will not be used by the assailant on his or her victim.

The personal safety device have several shocking electrodes located at different faces of the safety device wherein a shocking electrode gets inactivated when another shocking electrode is activated to prevent a user from being stung by the shocking electrode that is not aimed at the assailant.

The chemical spray triggering assembly comprises a triggering switch connected to a restraining triggering strip which presses upon the nozzle of a canister containing the chemical, the triggering switch controlled by the position of a series of strips perpendicularly situated from the triggering switch.

The process of using the personal safety device comprises switching the on/off switch for turning the lighting device on; turning the trigger switch on while the on/off switch is on to trigger the activation of the shocking electrodes on the top surface of the safety device when the shocking electrodes is desired to be used to ward off an assailant; pressing on a nozzle of a chemical spray canister to deliver a spray when a shock is not desired; pressing on the bottom surface having shocking electrodes to activate the bottom shocking electrode when an assailant is at the user's back, the activation of the bottom shocking electrodes causing the deactivation of the top shocking electrodes; and, pulling a safety device to disengage the shocking electrodes from the power source and dislocate the chemical spray canister thereby disabling the personal safety device.

BRIEF DESCRIPTION OF THE DRAWINGS

FIG. 2 is a vertical sectional view of the safety device shown in FIG. 1, taken on line a—a.

FIG. 2A is an exploded view of the receiver, fence and canister taken along b—b.

DETAILED DESCRIPTION OF THE INVENTION

Figure 1:
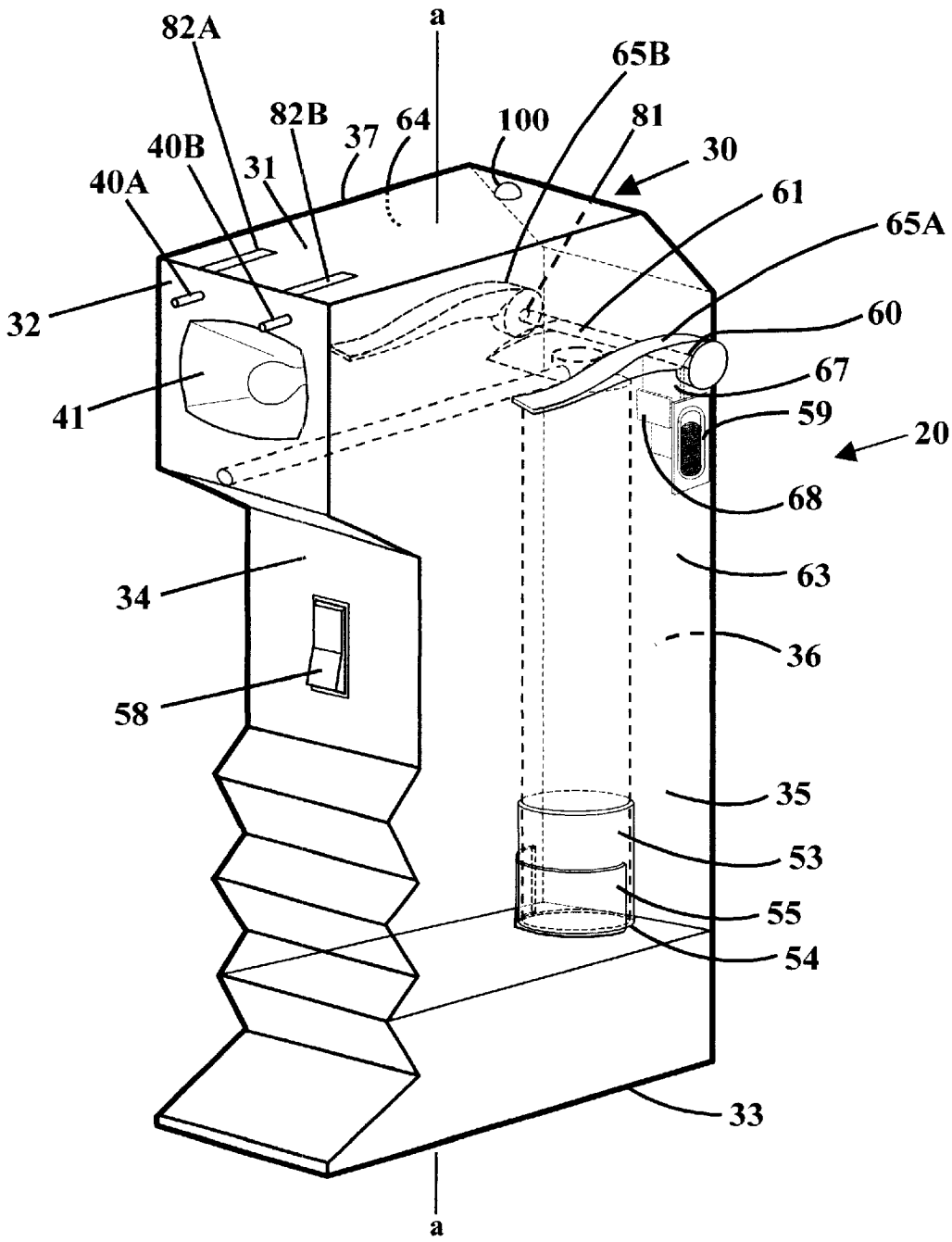
FIG. 1 is a perspective view of the personal safety device.

FIGS. 1 and 2 illustrates the personal safety device 20 on a housing 30. The housing 30 has a top surface 31, a front top surface 32 connecting to a first wall 34, a bottom surface 33, a second wall 35, a third wall 36 and a fourth wall 37. On the front top surface 32, proximal to the top surface 31 are preferably a pair of protruding primary shocking electrodes 40A and 40B which when activated, stings or shocks an intruder upon contact with the electrodes. Below the shocking electrodes 40A and 40B, on the front top surface 32 is curved out, an aperture 41, usually of oval, elliptical or rounded shape. The reflector 42 have walls 43 directing from and around the aperture 41, the wall preferably decreasing in circumferential surface in a conical manner. The reflector 42 connects to a base 44 for accommodating a lighting device 45. The fighting device 45 is commonly a light bulb usually screwed into the base 44. A hollow tube 46 extends from an opening 47 on the front top surface 32 which connects at its opposite end 48 to a nozzle 49 of a chemical spray canister 50. The opposite end 48 of the hollow tube 46 usually slips inside the nozzle 49. The nozzle is typically housed inside a pressure button 51 which controls the delivery of chemicals within the canister 50. The chemical spray canister 50 is usually located in the middle of the first inside compartment 52 of the housing 30. The canister 50 is preferably seated inside a receiver 53, preferably a hollow cylinder with a bottom base 54 or a receiver having a rounded surface on one end a flat surface on the other end as shown in FIG. 2A. The receiver 53 usually has the same geometric shape as the canister or the canister should fit into the receiver as in the case of receivers with a flat end as shown in FIG. 2A. The receiver 53 holding the canister 50 are in turn held on its curved or rounded surface by an arched fence 55 curved to conform with the geometric shape of the curved or rounded surface of the receiver 53 to stabilize the canister and prevent it from moving as shown in FIG. 1. The receiver 53 sits on top of a base 38 which is also the top surface of a second compartment 56 used for housing a battery and its accessories. The first wall 34 below the front top surface 32 is preferably recessed and designed to ergonomically accommodate the hand of a user. On the first wall 34 is a trigger switch 58 for triggering the shocking electrodes 40A and 40B.

Figure 3:
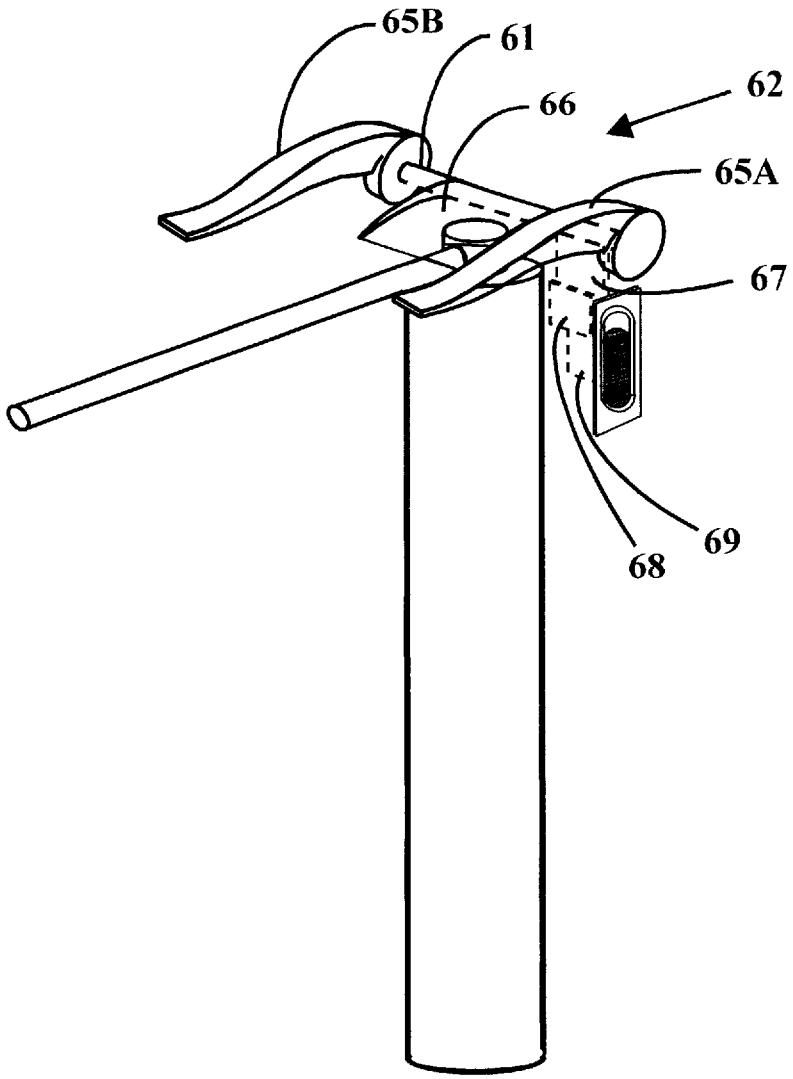
FIG. 3 is a perspective view of the chemical spray triggering assembly.

The second wall 35, as shown in FIG. 1, preferably has an on/off switch 59 for powering the personal safety device. On the surface of the second wall 35 is a hole 60 for accommodating a rod 61, preferably cylindrical in shape. The rod 61 is part of a chemical spray triggering assembly 62 shown in FIG. 3. The rod extends from one end on the outside surface 63 of the second wall 35 to the other end on the outside surface 64 of the fourth wall 37. On the respective ends of the rod 61 are connected mechanical triggering switches 65A and 65B which are located on the outside surfaces 63 and 64 of the second and fourth wall. Rigidly attached to the middle portion of the rod 61 is a restraining triggering strip 66. This strip 66 presses on the pressure button 51 of the canister 50 when the switches 65A and 65B are pressed downwards which moves the rod 61 in a counterclockwise direction. Connected to the rod 61, below the restraining triggering strip 66 proximal to the triggering switch 65A is a flat strip 67 oriented perpendicular to the restraining triggering strip 66. Extending internally from the inside of the second wall 35 is a rigid strip 68 proximal and parallel to the flat strip 67. The rigid strip 68 prevents the triggering switches 65A and 65B from moving clockwise because the flat strip 67 will hit the rigid strip 68. Connected at the back of the on/off switch 59 is a thin plate or a thin strip 69. The flat strip 67 is sandwiched between the thin strip 69 and the rigid strip 68. The thin plate 69 is oriented vertically in the same axial position as the rigid strip 68 and the flat strip 67. These various strips and plates are made of any rigid material. When the on/off switch is pushed upwards to the off position, the thin plate 69 also moves upwards thereby aligning with the flat strip 67. When the thin plate 69 is aligned with the flat strip 67, the triggering switches 65A and 65B are prevented from moving downwards which in turn prevent the restraining triggering strip 66 to press upon the pressure button 51 of the canister 50. When the on-off switch 59 is switched downwards to the on position, the thin plate 69 also moves downwards out of the way of the flat strip 67, thus allowing the mechanical triggering switches 65A and 65B to move downwards if force is applied onto these switches which consequently cause the triggering strip 66 to press upon the nozzle 49 of the canister 50 thereby allowing the chemical inside the canister 50 to flow through the hollow tube 46 and spray at an aimed position upon release to the atmosphere.

Figure 4:
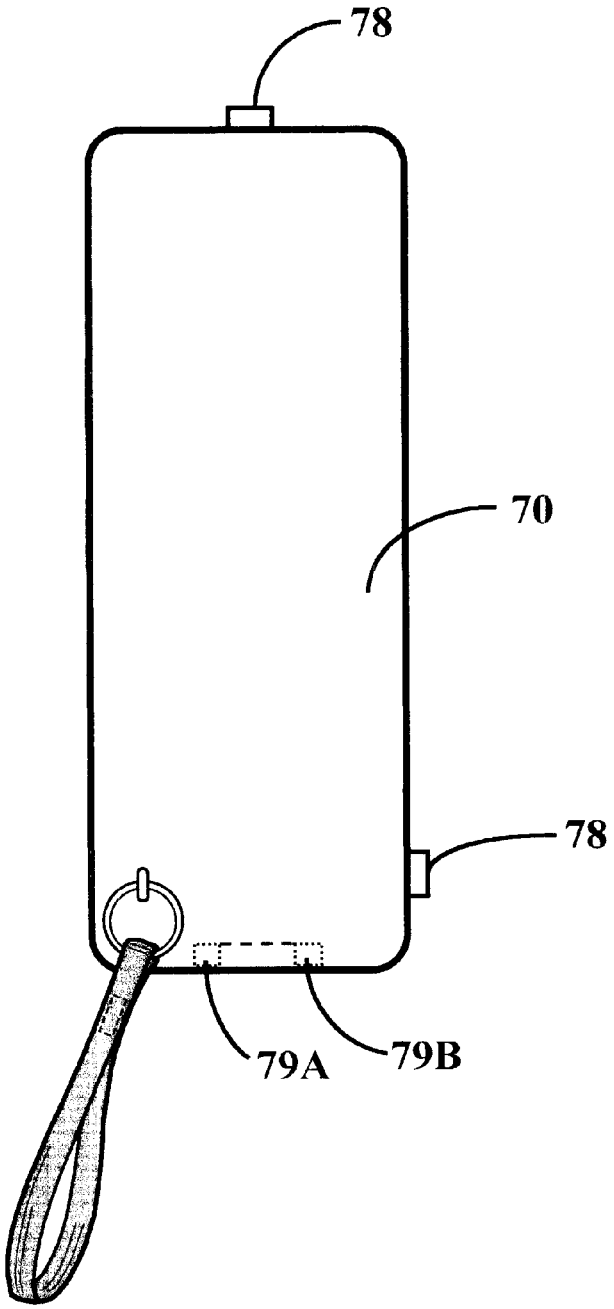
FIG. 4 is a plan view of the safety door of the safety device.
Figure 5:
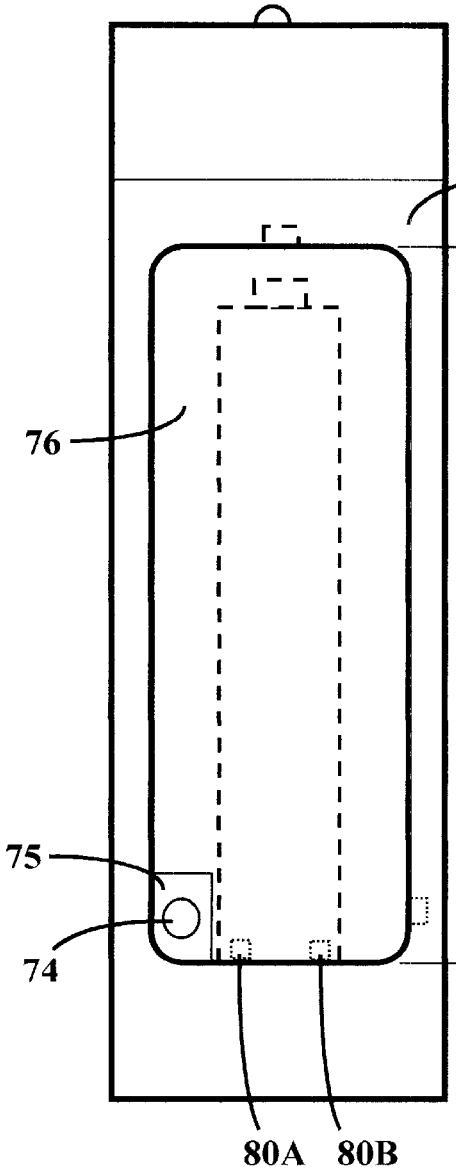
FIG. 5 is a plan view of the third wall of the safety device.
Figure 6:
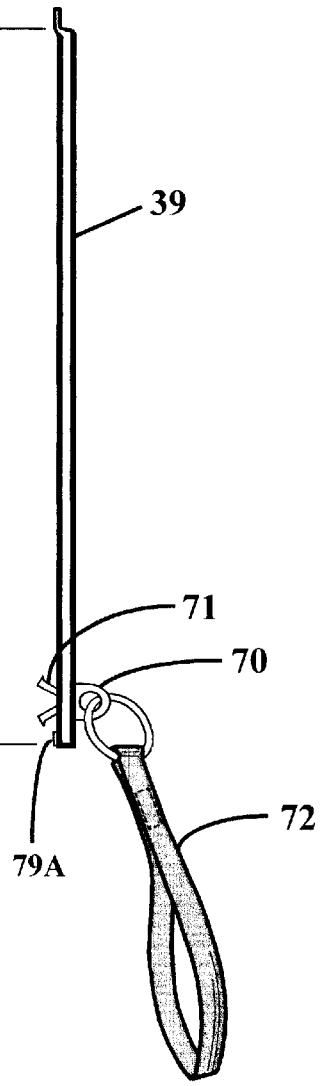
FIG. 6 is a side view of the safety door of the safety device.
Figure 7A:
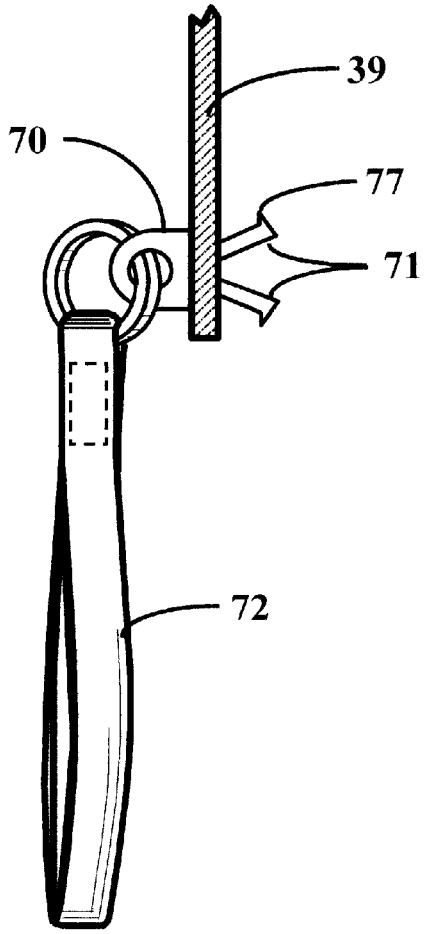
FIG. 7A is a sectional side view of the safety door showing the key connected to a wrist strap.
Figure 7B:
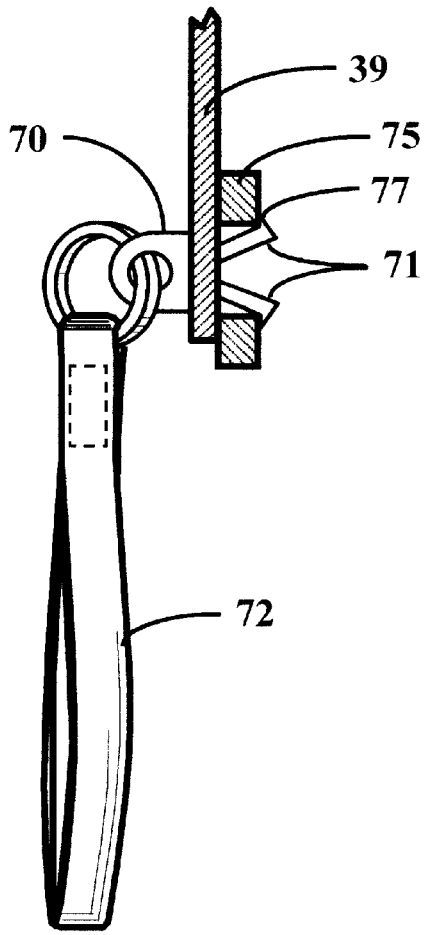
FIG. 7B is a sectional side view of the safety door showing the key engaged into a locking strip preventing the door from opening.

The third wall 36 can be used to house a safety door 39 as shown in FIGS. 4, 5 and 6 which can disable both the shocking electrodes 40A and 40B and the chemical spray assembly 62 once the safety door 39 is disengaged or pulled from the device 20. The safety door 39 has a locking mechanism which in here is illustrated by a key 70 having springy or resilient legs 71. Other locking devices may be used so long as it can disengage the safety door from the safety device when the safety door is pulled. To facilitate the disengagement of the safety door 39 from the device, the safety door is preferably connected to a wrist strap 72 through which extends a user's wrist while gripping the personal safety device. The wrist strap on the user's hand will allow the user to hold on to the strap when the safety device 20 is being grabbed by the assailant such that the pull from the assailant will make the door 39 disengage from the body of the personal safety device 20. In the locking mechanism illustrated on FIGS. 7A and 7B, the wrist strap 72 is connected to the locking mechanism or key 70. The safety door 39 disconnects the electrical connections from the shocking electrodes 40A and 40B by disengaging the safety conducting strips 79A and 79B located at the bottom inside cover of the safety door 39 from the contacts 80A and 80B which allows the current to flow through from the power source. A pull of the door also disables the chemical spray assembly 62. This is made possible by fastening the receiver 53 housing the canister 50 to the inside cover of the safety door 39 as shown in FIG. 2 and 2A such that when the safety door is pulled out of the safety device, the door either carries with it the receiver 53 containing the canister 50 or dislocates the canister such that the chemical spray assembly 62 is no longer operable. A preferred fastening device is a hook and loop fastener 73, commercially sold as Velcro®, where a strip or a piece of a Velcro®loop is applied on the surface of the receiver 53 facing the door 39 and the corresponding strip or piece of Velcro® hook is applied on the inside cover of the door 39 on a face to face orientation such that when the safety door 39 is closed, the door 39 also fastens to the receiver 53. The door is kept in place or locked to the third wall by allowing the resilient legs 71 to lock into a hole 74 cut out from a plate 75 which protrudes laterally from the opening 76 of the third wall 36 as shown in FIG. 5. The resilient legs 71 have a hook like tip or a lip tip 77 which anchors on the inside surface of the plate 75. When the safety door 39 is engaged to the personal safety device 20, the safety door 39 fastens to the receiver 53 and the conducting strips 79A and 79B touch the contacts 80A and 80B.

The fourth wall 37 has a hole 81 directly opposite the hole 60 on the second wall 35 for accommodating an end of the rod 61 of the chemical spray triggering assembly 62 as shown in FIG. 1.

The top surface 31 of the personal device 20 preferably contain two flat strip shocking electrodes 82A and 82B as shown in FIG. 1, in addition to the shocking electrodes 40A and 40B also for shocking an assailant upon contact with the electrodes. Also on the same surface 31 is preferably incorporated, an indicator 100 for indicating the charge level on the battery.

Figure 8:
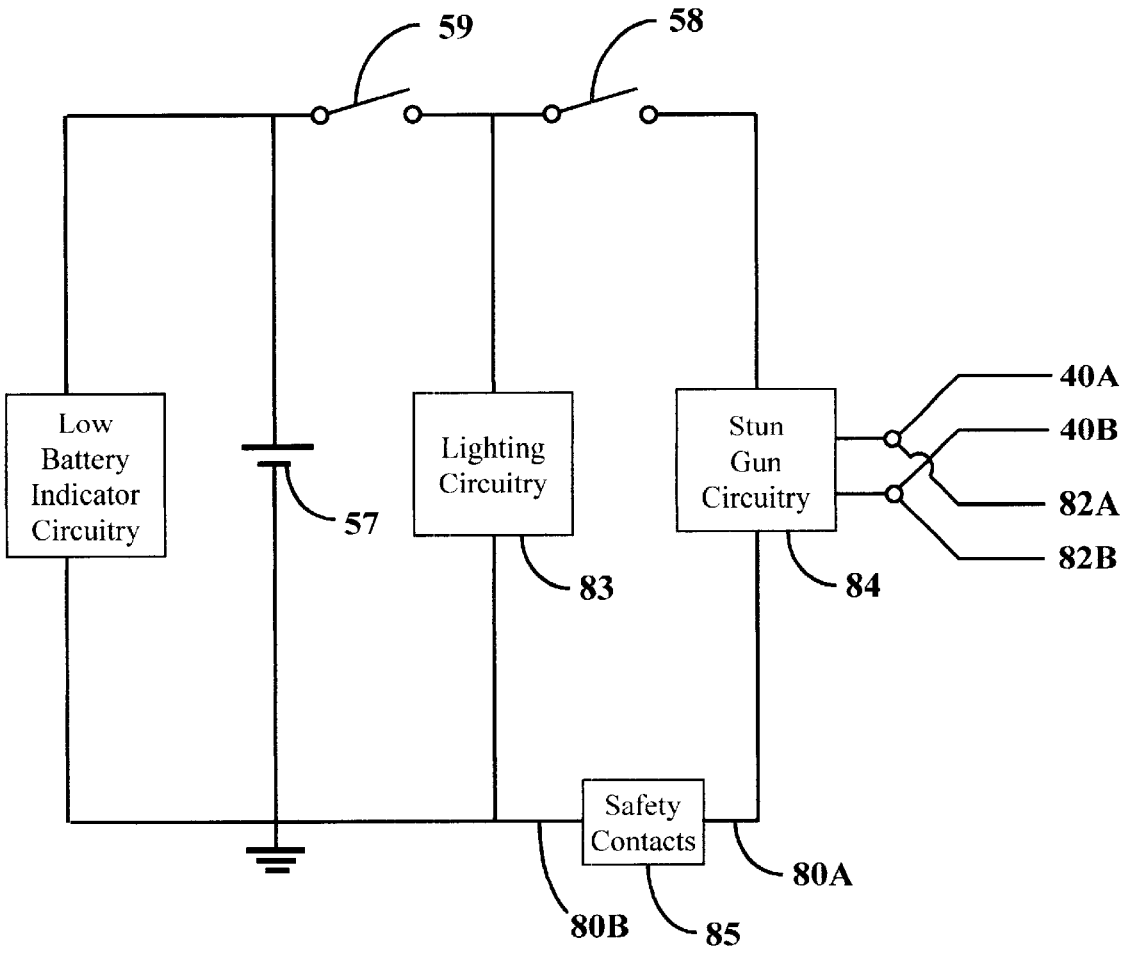
FIG. 8 is a circuit diagram showing how the safety device is powered.

The electrical circuitry involved in the operation of the personal safety device 20 is shown in FIG. 8. The device 20 is powered through the on/off switch 59. When the switch 59 is on, the lighting circuitry 83 connects with the battery 57 thereby turning the lighting device 45 on. This allows the user to use the personal safety device 20 as a flashlight which lights a dim place and aids in the identification of an assailant. When the trigger switch 58 is pressed or turned on while the on/off switch is also on, the shocking electrode powered through the stun gun circuit 84 will connect with the battery 57 through the safety contacts 85 consisting of the conducting strips 79A and 79B and the contacts 80A and 80B, thereby energizing the protruding primary shocking electrodes 40A and 40B and the flat strip shocking electrodes 82. The conducting strips 79A and 79B are preferably constructed of two conducting metal strips connected together with a conducting wire such as a copper wire. A low battery indicator may be attached to the battery to sense when the battery is no longer providing the right amount of energy. A battery door (not shown) is cut out from the bottom surface 33 to enable the replacement of a spent battery. The design and construction of battery doors are known.

Figure 9:
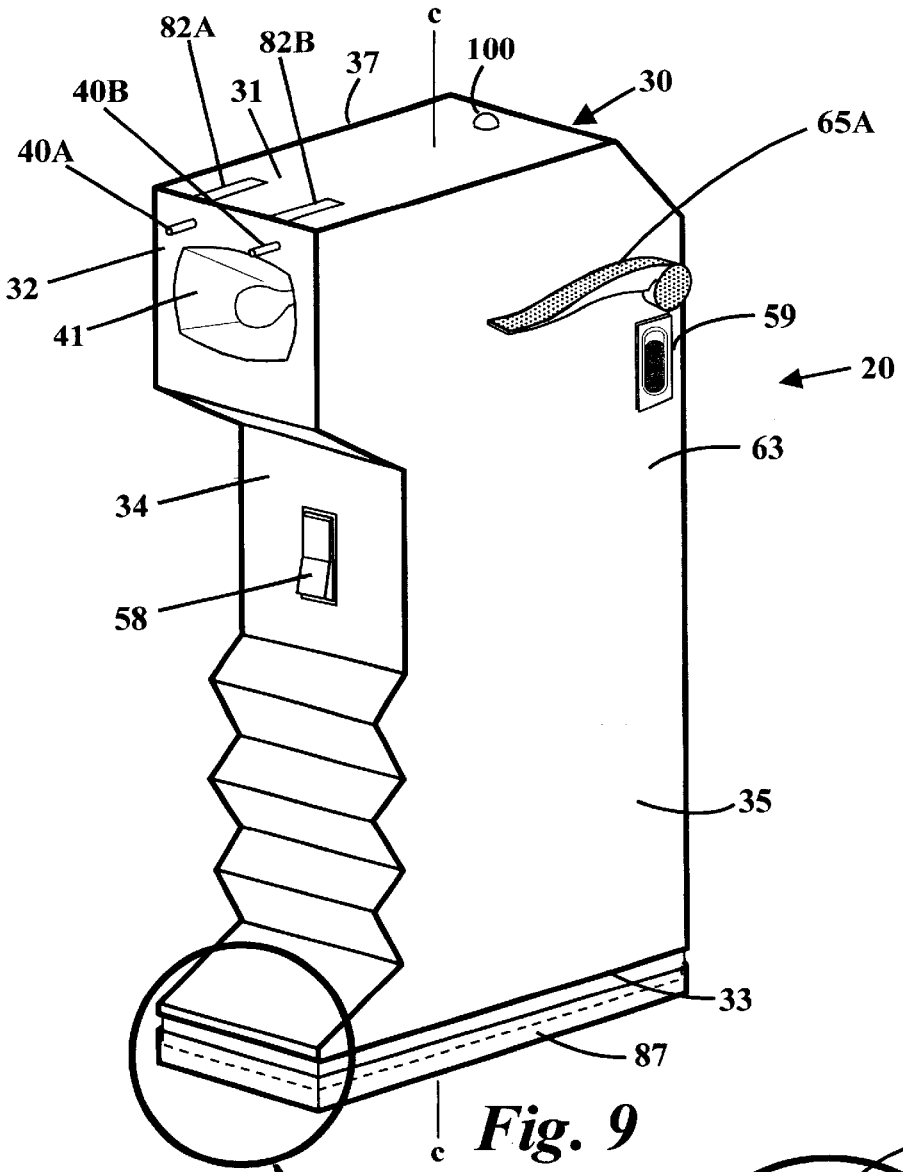
FIG. 9 is a perspective view of the personal safety device with a bottom extension to accommodate a secondary stun gun activation assembly.
Figure 9A:
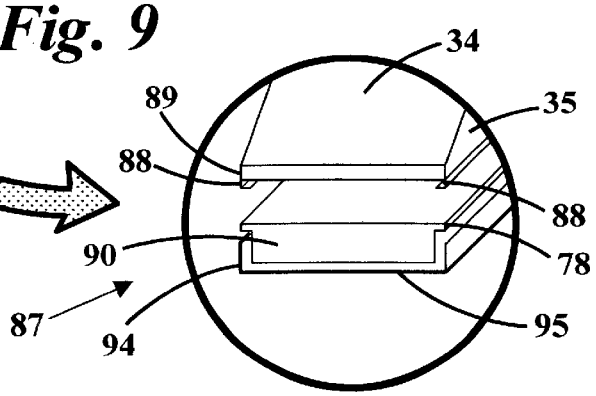
FIG. 9A is a perspective view showing the shocking electrode triggering assembly sliding into the overhanged rail at the bottom of the personal safety device.
Figure 10:
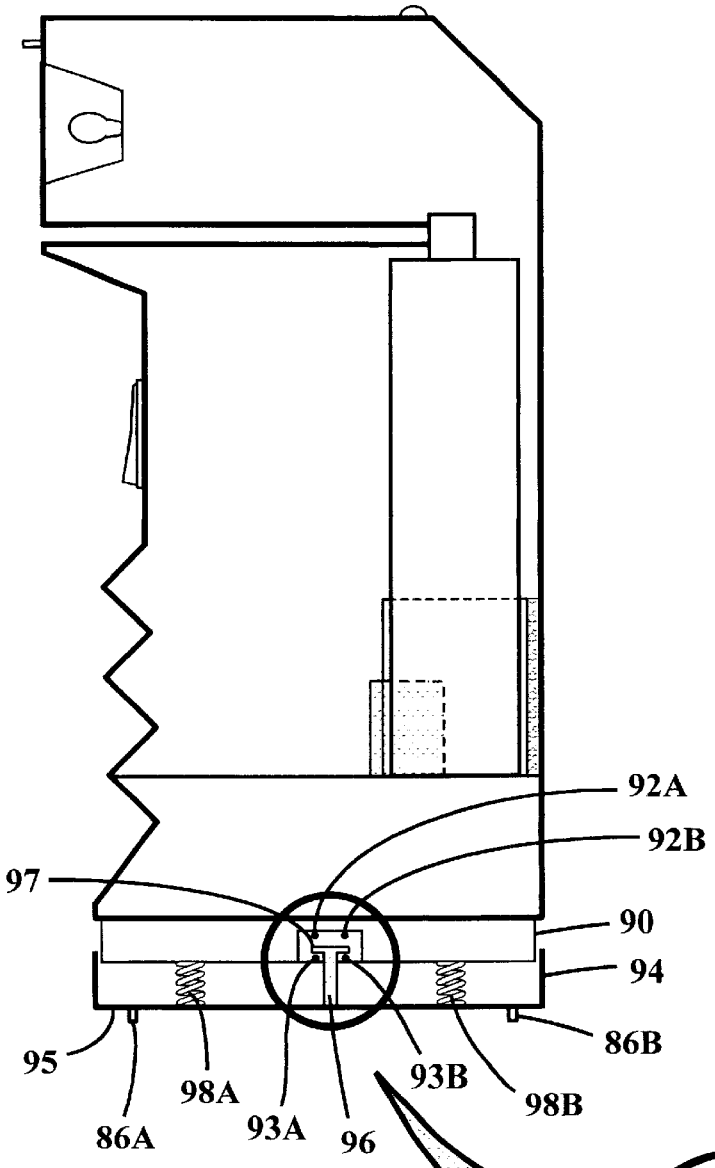
FIG. 10A is a vertical sectional view of the safety device taken along c—c having the secondary stun gun activation assembly in an inactive status with the disc touching a first conducting strip.
FIG. 10B is a vertical sectional view of the safety device taken along b—b having the secondary stun gun activation assembly in an active status with the disc touching a second conducting strip.
Figure 10A:
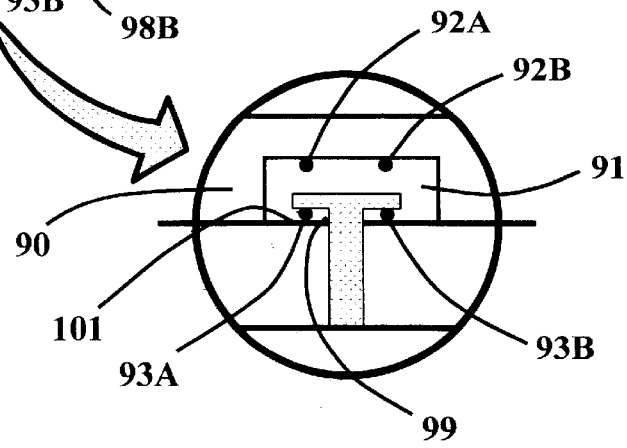

At least two additional shocking electrodes 86A and 86B protruding from the bottom surface 33 of the personal safety device 20 may be installed for defense against an assailant from the back. To accommodate this, the bottom portion of the safety device has to be extended to house this additional shocking electrode triggering assembly 87. The personal safety device 20 may also have these additional shocking electrodes as add on accessories, in which case, the bottom surface 33 should be removable to allow the add on accessory to be slid into the bottom of the personal safety device 20 as shown in FIGS. 9 and 9A. In either design, the parts of the additional shocking electrode triggering assembly 87 also herein referred to as secondary triggering assembly, will be the same. For the add on feature, the bottom surface 33 may be removed by sliding the bottom surface from an overhang rail 88 bordering the peripheral surfaces 89 of the second, third and fourth wall. The secondary triggering assembly 87 is attached to the bottom of the safety device preferably by sliding the assembly into the overhanged rail as shown in FIGS. 9 and 9A. The secondary triggering assembly 87 as shown in FIG. 10A, comprises a rigid block 90 with a center cavity 91. The central cavity is preferably circular with connecting terminals 92A and 92B at the top of the cavity and another connecting terminals 93A and 93B at the bottom wall 101 of the central cavity. The bottom edge of the central cavity 99 is circular and is the opening through which a rod 96 can go through. To slide the assembly 87 into the overhanged rail 88, a groove or a matching lip or protrusion 78 at the peripheral lateral surfaces of the block 90 is inserted into the overhanged rail as shown in FIG. 9A. A cover 94 capable of enveloping the rigid block 90 has a solid base 95 having a rod 96 extending inwardly from the solid base. At the tip of the rod is a circular conductive disc 97 having a larger outer diameter than the rod 96 and the bottom edge 99 of the central cavity which keeps the rod 96 from falling away from the central cavity 91 and the cover 94 attached to the triggering assembly 87. The rod 96 can be made of conducting and non-conducting rigid materials so long as the disc 97 is a conducting material. The methods for attaching the disc to the rod is known. On the left and right side of the rod are spring coils 98A and 98B whose top and bottom ends are connected to the rigid block 90 and the solid base 95, respectively. The additional shocking electrode/s 86A&B protrude outwardly from the outside surface of the solid base 95. This connects to the same battery 57.

Figure 10B:
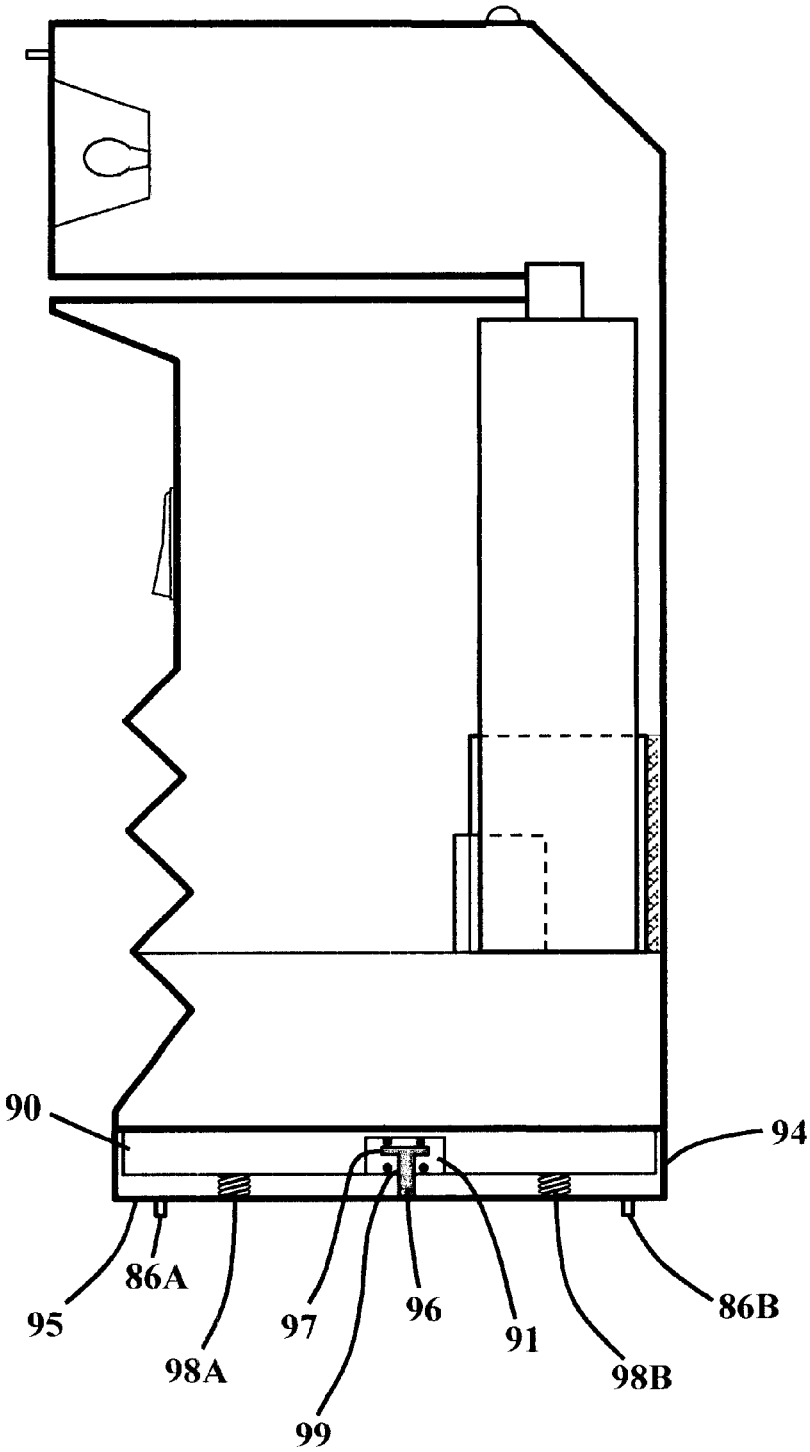
Figure 11:
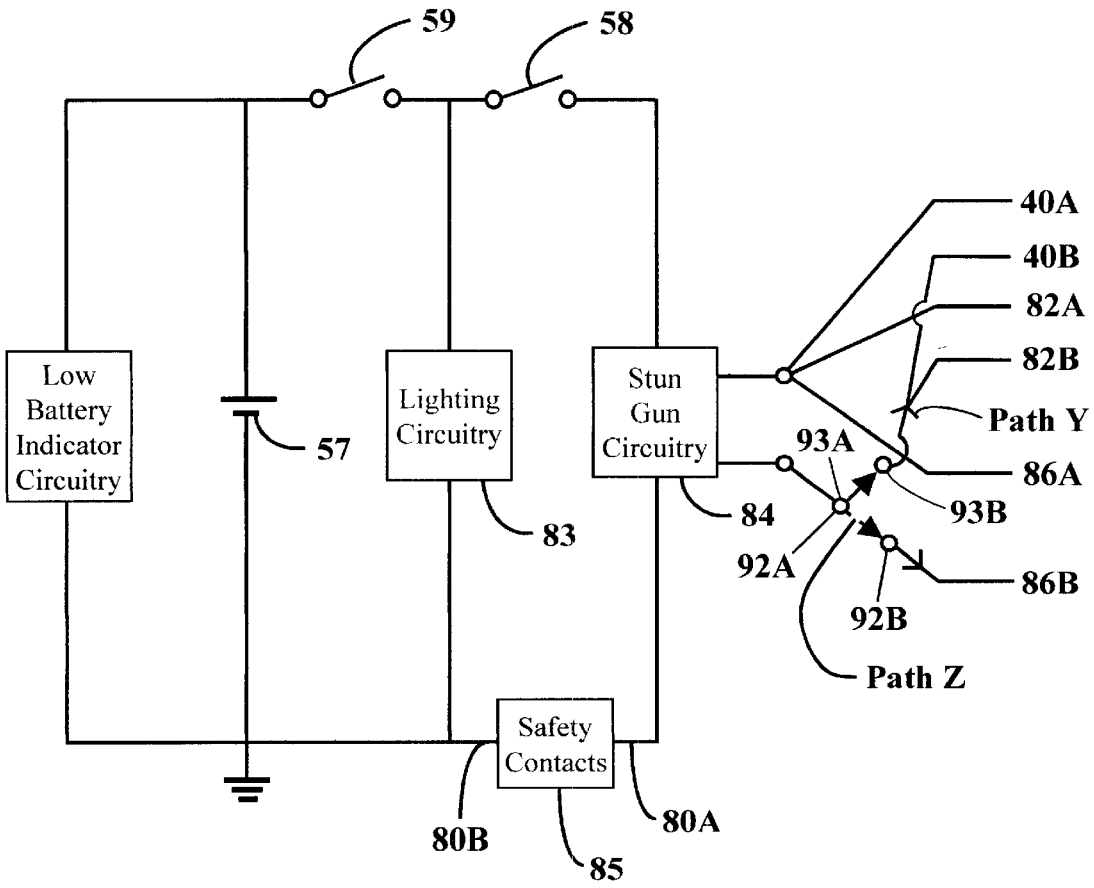
FIG. 11 is a circuit diagram showing how the safety device with a secondary stun gun is powered.

When no outside force is applied to the additional shocking electrodes 86A and 86B, the spring coils 98A and 98B will be in a relax position, causing the circular conductive disc 97 to touch on the connecting terminals 93A and 93B located at the bottom wall 101 of the central cavity 91. When the conductive disc 97 is in contact with the connecting terminals 93A and 93B, the electric current flows through the shocking electrodes 40A, 40B, 82A and 82B and no current flows through the additional shocking electrode/s 86A&B as shown in FIG. 10A and FIG. 11, path Y. When force is applied to the secondary electrodes 86A&B, preferably a pair, the cover 94 pushes against the spring coils 98A and 98B which cause the rod 96 to also push upward thereby disengaging the circular conductive disc 97 from its contact with the connecting terminals 93A and 93B but engaging this with the connecting terminals 92A and 92B as shown in FIG. 10B. When the conductive disc 97 is in contact with the connecting terminals 92A and 92B, no electric current can flow through the shocking electrodes 40A, 40B, 82A and 82B but instead, electric current will flow through the additional shocking electrodes 86A and 86B as shown in FIG. 11, path Z. To cause a good contact of the circular conductive disc 97 with the connecting terminals 92A,B and 93A,B, a cylindrical channel (not shown) may be installed from the bottom edge 99 of the central cavity 91. The length of the cylindrical channel is preferably the same as the distance from the connecting terminals 92A,B to the connecting terminals 93A,B. This cylindrical channel will hold the rod 96 inside and stabilize it as it travels to and from one connecting terminal to the other. To activate the additional shocking electrodes 86A&B, both the trigger switch 58 and the on/off switch 59 should be in the on position, and force should be applied to the additional shocking electrodes. This requirement is designed to prevent the accidental activation of the additional shocking electrodes 86A&B.

Unless specifically stated, the personal safety device is preferably made of a rigid plastic material.

I claim:

1. A personal safety device, comprising:

a housing having a top surface, a front top surface connected to a first wall, a bottom surface, a second wall, a third wall and a fourth wall designed to ergonomically accommodate a hand of a user;

a combination of a lighting device attached to a base of a reflector on the front top surface, a chemical spray canister having a nozzle housed inside a pressure button for controlling the delivery of chemicals from the canister, the nozzle connected to a hollow tube extending from the nozzle to the front top surface of the housing and shocking electrodes in the housing;

means for securing the personal safety device to a user's hand;

means for triggering and turning off the lighting device;

means for triggering and turning off the chemical spray;

means for triggering and turning off the shocking electrode; and, means for disabling the personal safety device when the said device is pulled from the user's hand.

2. The personal safety device of claim 1 wherein the lighting device is a light bulb.

3. The personal safety device of claim 1 wherein the housing has a receiver for holding the canister.

4. The personal safety device of claim 3 wherein the receiver has a rounded surface on one end and a flat surface on the other end.

5. The personal safety device of claim 3 wherein the receiver is a hollow cylinder.

6. The personal safety device of claim 1 wherein the housing has an arched fence to stabilize the canister in place.

7. The personal safety device of claim 1 wherein the housing has at least two compartments, one compartment housing the lighting device, the chemical spray canister and the shocking electrode and the other compartment housing a battery and its accessories.

8. The personal safety device of claim 1 wherein the chemical spray canister is triggered by a triggering assembly comprising a triggering switch on one end of a rod, a restraining triggering strip for pressing on the pressure button of the canister when the triggering switch is in an on position, a series of strips oriented perpendicular to the restraining triggering strip, the strips controlling the movement of the triggering switch thereby controlling the ability of the restraining triggering strip to press on the pressure button of the canister.

9. The personal safety device of claim 1 wherein a shocking electrode is at the top surface of the said safety device.

10. The personal safety device of claim 1 wherein the means for disabling the personal safety device is a safety door attached to the chemical spray canister and the means for triggering the shocking electrode, whereby pulling the safety door from the said personal safety device disconnects the shocking electrode and dislocates the chemical spray canister.

11. The personal safety device of claim 10 wherein the safety door is attached to the canister by a hook and loop fastener attached to a receiver housing the canister.

12. The personal safety device of claim 1 wherein the means for securing the personal safety device is a wrist strap.

13. The personal safety device of claim 1 further comprising an indicator for indicating a charge level of a battery.

14. The personal safety device of claim 1 further comprising an additional shocking electrode protruding from the bottom surface of the said safety device.

15. The personal safety device of claim 14 wherein the additional shocking electrode is an add on accessory that can be attached or removed from the personal safety device.

16. A personal safety device, comprising:

a housing having a top surface, a front top surface connected to a first wall, a bottom surface, a second wall, a third wall and a fourth wall designed to ergonomically accommodate a hand of a user;

a combination of a lighting device, a chemical spray canister having a nozzle housed inside a pressure button for controlling the delivery of chemicals from the canister, the nozzle connected to a hollow tube extending from the nozzle to the front top surface of the housing, a shocking electrode on the top surface, a shocking electrode on the bottom surface;

a receiver on the housing, the receiver having a rounded surface on one end and a flat surface on the other end for holding the canister;

means for securing the personal safety device to a user's hand;

means for triggering and turning off a lighting device;

means for triggering and turning off a chemical spray;

means for alternate triggering and turning off of a shocking electrode; and, means for disabling the personal safety device when the said device is pulled from the user's hand.

17. A process of using a personal safety device comprising:

switching an on/off switch for turning a lighting device on;

turning a trigger switch on while the on/off switch is on to trigger the activation of a shocking electrode on a top surface of the personal safety device when the shocking electrodes is desired to be used to ward off an assailant;

pressing on a nozzle of a chemical spray canister to deliver a chemical spray;

pressing on a bottom surface of the personal safety device having a shocking electrode to activate the bottom shocking electrode when an assailant is at the user's back, the activation of the bottom shocking electrodes causing the deactivation of the top shocking electrodes; and, pulling a safety device to disengage the shocking electrode from a power source and dislocate the chemical spray canister thereby disabling the personal safety device when the said safety device is pulled from a user.

18. The personal safety device of claim 16 wherein the receiver is a hollow cylinder.

19. The personal safety device of claim 16 wherein the housing has an arched fence to stabilize the canister in place.

20. The personal safety device of claim 16 wherein the housing has at least two compartments, one compartment housing the lighting device, the chemical spray canister and the shocking electrode and the other compartment housing a battery and its accessories.

21. The personal safety device of claim 16 wherein the chemical spray canister is triggered by a triggering assembly comprising a triggering switch on one end of a rod, a restraining triggering strip for pressing on the pressure button of the canister when the triggering switch is in an on position, a series of strips oriented perpendicular to the restraining triggering strip, the strips controlling the movement of the triggering switch thereby controlling the ability of the restraining triggering strip to press on the pressure button of the canister.

22. The personal safety device of claim 16 wherein the means for disabling the personal safety device is a safety door attached to the chemical spray canister and the means for triggering the shocking electrode, whereby pulling the safety door from the said personal safety device disconnects the shocking electrode and dislocates the chemical spray canister.

23. The personal safety device of claim 22 wherein the safety door is attached to the canister by a hook and loop fastener attached to a receiver housing the canister.

24. The personal safety device of claim 16 wherein the means for securing the personal safety device is a wrist strap.

25. The personal safety device of claim 16 further comprising an indicator for indicating a charge level of a battery.

26. The personal safety device of claim 16 wherein the additional shocking electrode on the bottom surface is an add on accessory that can be attached or removed from the personal safety device.

* * * * *